US010995498B1

(12) United States Patent
Fein

(10) Patent No.: US 10,995,498 B1
(45) Date of Patent: May 4, 2021

(54) POLYGON TILE FOR TESSELLATING AND METHOD OF MAKING THE SAME

(71) Applicant: Harvey Fein, Long Island City, NY (US)

(72) Inventor: Harvey Fein, Long Island City, NY (US)

( * ) Notice: Subject to any disclaimer, the term of this patent is extended or adjusted under 35 U.S.C. 154(b) by 0 days.

(21) Appl. No.: 17/148,753

(22) Filed: Jan. 14, 2021

(51) Int. Cl.
*E04F 13/08* (2006.01)
*E04F 13/00* (2006.01)

(52) U.S. Cl.
CPC ..... *E04F 13/0871* (2013.01); *E04F 13/002* (2013.01)

(58) Field of Classification Search
CPC . E04F 13/0871; E04F 13/002; E04F 13/0862; B32B 37/02
USPC ..... 52/311.2
See application file for complete search history.

(56) References Cited

U.S. PATENT DOCUMENTS 4,718,214 A * 1/1988 Waggoner ..... E04C 2/32 52/309.13
4,963,408 A * 10/1990 Huegli ..... B32B 5/16 428/71
6,068,907 A * 5/2000 Beauregard ..... B32B 5/28 428/71
6,117,514 A * 9/2000 Herrmann ..... E04B 9/0428 428/177
10,508,456 B1 * 12/2019 Yang ..... B32B 3/30
2004/0074208 A1 * 4/2004 Olson ..... F16L 59/065 52/794.1
2009/0022959 A1 * 1/2009 Snel ..... B32B 13/08 428/174
2010/0218363 A1 * 9/2010 Zahner, III ..... E04F 13/0871 29/527.4
2015/0315797 A1 * 11/2015 Masotti ..... E04F 13/077 156/154
2015/0322679 A1 * 11/2015 Vigouroux ..... E04F 13/0837 52/506.05
2016/0265237 A1 * 9/2016 Martin ..... B44C 5/04
2017/0234018 A1 * 8/2017 Bovijn ..... A47G 27/0437 52/506.05
2018/0226917 A1 * 8/2018 Jacques ..... H02S 40/38
2019/0119899 A1 * 4/2019 Hoy ..... E04F 13/0855
2020/0256060 A1 * 8/2020 Kulp, III ..... E04F 13/0871

* cited by examiner

*Primary Examiner* — Paola Agudelo
(74) *Attorney, Agent, or Firm* — Michael J. Feigin, Esq.; Feigin and Fridman LLC

(57) ABSTRACT

A polygon tile for tessellating includes a body, a cross-member attached to the body, and a sheet extending tautly over the body and the cross-member. The body includes an upper surface, a lower surface, and a perimeter wall defining a first corner, a second corner, and a third corner. The cross-member extends from the first corner to the third corner and includes a first end, a second end, a middle portion, a bottom end attached to the upper surface, and a top end tapering to an apex. The cross-member tapers in height from the middle portion to the first and second ends forming a bowed curvilinear shape. The first and second ends are substantially coextensive with the body. The sheet extends tautly over the perimeter wall and is attached to the lower surface of the body. The sheet slopes from the middle portion to the perimeter wall in all directions.

17 Claims, 13 Drawing Sheets

POLYGON TILE FOR TESSELLATING AND METHOD OF MAKING THE SAME

FIELD OF THE DISCLOSED TECHNOLOGY

The disclosed technology relates generally to tiles for creating tessellated art. More specifically, the present disclosed technology relates to a geometric polygon tile for forming or creating tessellations.

BACKGROUND

A tiling or tessellation of a flat surface, such as canvas, is the covering of a plane using one or more geometric shapes, called tiles, with no overlaps and no gaps. Indeed, tessellations are the resultant patterns formed from arranging these tiles such that they include no gaps or overlaps. For example, a tessellation can be made by positioning the same shaped tile using one of three operations: translation; rotation; and reflection. Translation can be thought of as sliding the shape along a plane. Rotation tessellations are accomplished by rotating the tessellated shape. Reflection tessellations are mirrored.

There are many different geometric tiles one can utilize to create a tessellation; however, the majority of tessellations are formed from 2-dimensional tracings of these tile shapes as opposed to from three-dimensional tiles including unique structures. Accordingly, there is a need for a geometric polygon tile including a 3-dimensional shape for creating 3-dimensional tessellations on surfaces, which form unique topographies thereon.

SUMMARY OF THE DISCLOSED TECHNOLOGY

Disclosed herein is polygon tile for tessellating including a planar geometric body, an elongated cross-member, and a sheet. The geometric body includes a flat upper surface, a lower surface opposite the flat upper surface, and a side perimeter wall extending between the flat upper surface and the lower surface. The side perimeter wall defines at least a first corner, a second corner, and a third corner, wherein the second corner is disposed between the first corner and the third corner. The elongated cross-member extends from the first corner to the third corner and includes a first end, a second end opposite the first end, a middle portion disposed between the first end and the second end, a bottom end including a flat surface attached to the flat upper surface of the body, and a tapered top end tapering in width to an apex. The elongated cross-member tapers in height from the middle portion to the first end and from the middle portion to the second end such that the height of the cross-member at the middle portion is larger than the height of the cross-member at the first end and the second end. The elongated cross-member includes a width smaller than a width of the body. The sheet extends tautly over the cross-member, the flat upper surface, and side perimeter wall of the body. The sheet slopes from the middle portion of the cross-member to the side perimeter wall.

In embodiments, the first end of the cross-member is disposed above the first corner, the second end of the cross-member is disposed above the second corner, and the elongated cross-member tapers in height from the middle portion to the first end and from the middle portion to the second end such that the first end is substantially coextensive in height with the first corner and the second end is substantially coextensive in height with the second corner.

In some embodiments, the cross-member tapers in height from the middle portion to the first end and the second end such that the tapered top end is coextensive with the flat bottom end at the first end and the second end.

In various embodiments, the cross-member tapers in height from the middle portion to the first end and the second end such that the tapered top end is curvilinear forming a bowed shape.

In certain embodiments, the body further comprises an upper chamfered edge extending from the flat upper surface to the side perimeter wall.

In other embodiments, the sheet rests flat on the chamfered edge of the body.

In embodiments, the sheet comprises a perimeter edge attached to the lower surface of the body.

In some embodiments, the first corner, the second corner, and the third corner each form an angle within the range of 0° to 180°.

In certain embodiments, the body comprises either wood, plastic, metal, fiberglass, glass, ceramic, or any combination of the same.

In various the cross-member comprises either wood, plastic, metal, glass, ceramic, or any combination of the same.

In other embodiments, the sheet comprises either fabric material, a laminate material, a plastic material, a paper material, or any combination of the same.

Further disclosed herein is method of making a polygon tile for tessellating including attaching an elongated cross-member including a first end, a second end, a middle portion disposed between the first end and the second end, a flat bottom end including a flat surface, and a tapered top end tapering in width to an apex to a geometric polygon shaped planar body including a flat upper surface, a lower surface, a first corner, a second corner, and a third corner, the second corner disposed between the first corner and the third corner, extending a sheet of material tautly over the elongated cross-member and the body, and attaching the sheet of material to the body such that the sheet remains tautly extended over the cross-member and the body, and the sheet slopes from the middle portion of the cross-member to the side perimeter wall, wherein the elongated cross-member tapers in height from the middle portion to the first end and to the second end such that the height of the cross-member at the middle portion is larger than the height of the cross-member at the first end and the second end.

In some embodiments, the cross-member is attached to the body by positioning the cross-member on the flat upper surface of the body between the first corner and the third corner of the body, such that the cross-member extends from the first corner the third corner and adhering the flat surface of the bottom end of the cross-member to the flat upper surface of the body.

In certain embodiments, the first end of the cross-member is substantially coextensive in height with the first corner and the second end of the cross-member is substantially coextensive in height with the second corner.

In other embodiments, the cross-member tapers in height from the middle portion to the first end and the second end such that the tapered top end is coextensive with the flat bottom end at the first end and the second end and that the tapered top end is curvilinear forming a bowed shape.

In embodiments, the body further comprises an upper chamfered edge extending from the flat upper surface to the side perimeter wall and the sheet comprises a perimeter edge.

In some embodiments, the sheet of material is attached to the body by extending the sheet of material over the body and the cross-member such that the sheet of material rests flat on the chamfered edge of the body and the sheet of material is pulled over the side perimeter wall to the lower surface of the body and adhering the perimeter edge of the sheet of material to the lower surface of the body.

"Polygon" is defined as "a plane figure, or structure, with at least three angles and straight sides." "Geometric" is defined as "using straight or curved lines in designs or outlines, and/or of or relating to art based on shapes." "Coextensive" is defined as "extending over the same space and/or corresponding substantially the same, or exactly, in extent." "Curvilinear" is defined as "contained by or consisting of, entirely or partially, a curved line or lines." "Chamfered" is defined as "a cut-away, such as a cut-away at a right-angled edge or corner to make a symmetrical sloping edge." "Laminate" is defined as "a laminated structure, or material, made of layers fixed together to form a hard, flat, or flexible material." "Three-dimensional" also referred to as 3-dimensional or 3D herein, is defined as "having a length, a width, and a depth. "Topography" is defined as "the three-dimensional arrangement, outline, or contour of an item or area."

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

The disclosed technology provides a polygon tile for forming a three-dimensional tessellation including a planar geometric body, an elongated cross-member, and a sheet. The polygon tile may be tessellated on a wall or surface, such as a canvas, with various of the same or similar polygon tiles to form a tessellated work of art including a three-dimensional structure and topography.

Figure 1:
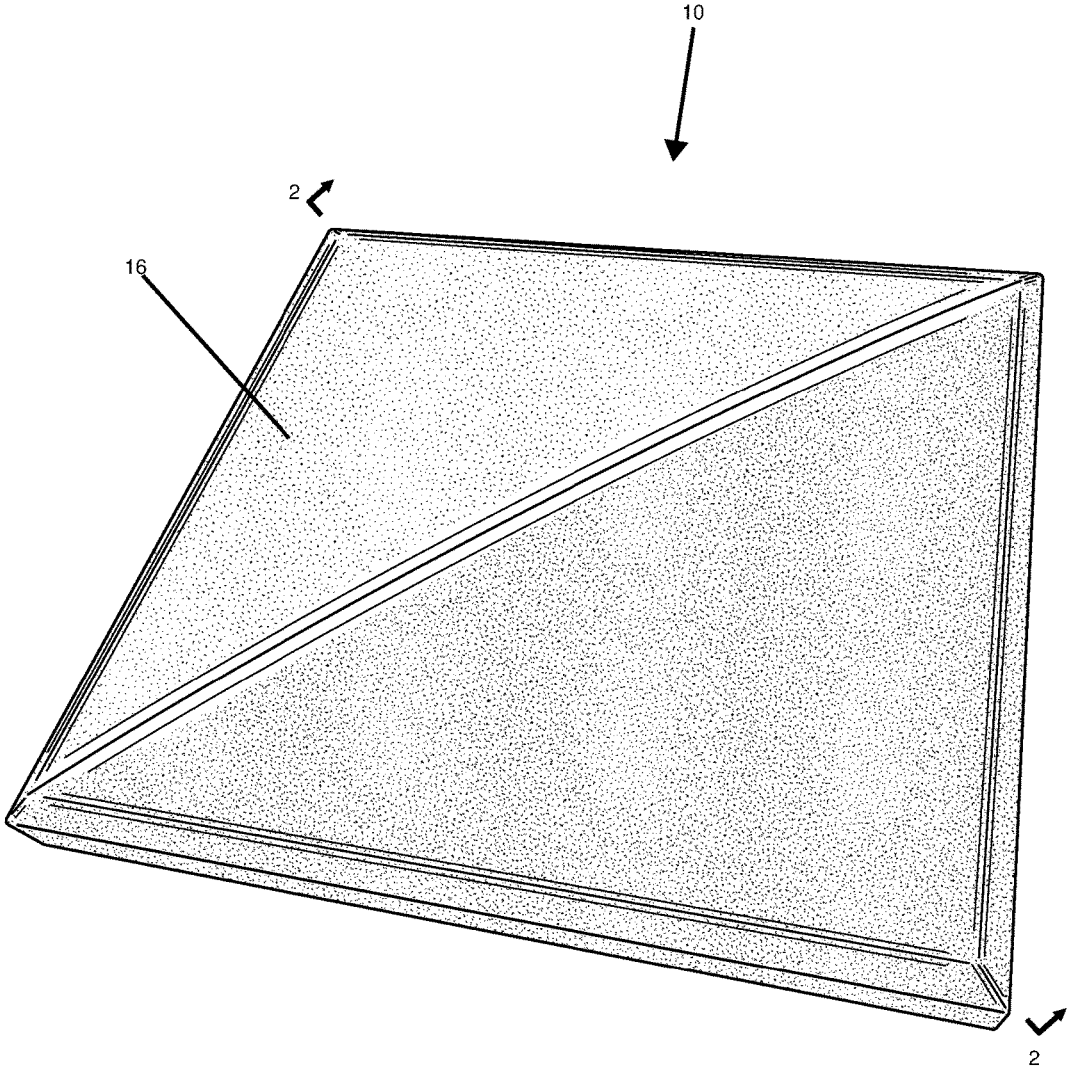
FIG. 1 shows a perspective view of the polygon tile according to one embodiment of the present disclosed technology.
Figure 2:
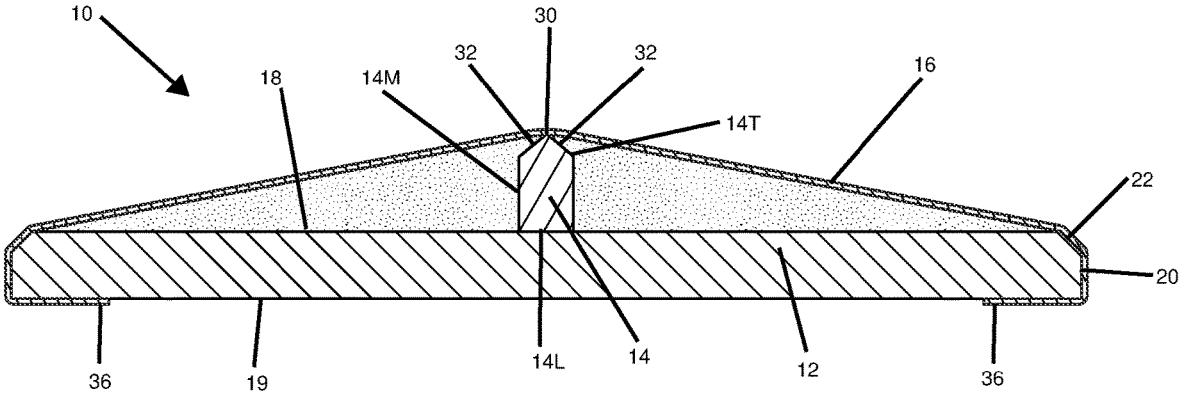
FIG. 2 shows a cross-sectional view along line 2-2 of FIG. 1, illustrating the relative configuration of the cross-member, geometric body, and sheet of the polygon tile according to one embodiment of the present disclosed technology.

Referring now to FIG. 1 and FIG. 2, simultaneously, FIG. 1 shows a perspective view of the polygon tile according to one embodiment of the present disclosed technology. FIG. 2 shows a cross-sectional view along line 2-2 of FIG. 1, illustrating the relative configuration of the cross-member, geometric body, and sheet of the polygon tile according to one embodiment of the present disclosed technology. The polygon tile 10 comprises a planar geometric body 12, an elongated cross-member 14 attached to the planar geometric body 12, and a sheet 16 extending tautly over the planar geometric body 12 and the elongated cross-member 14.

Figure 3:
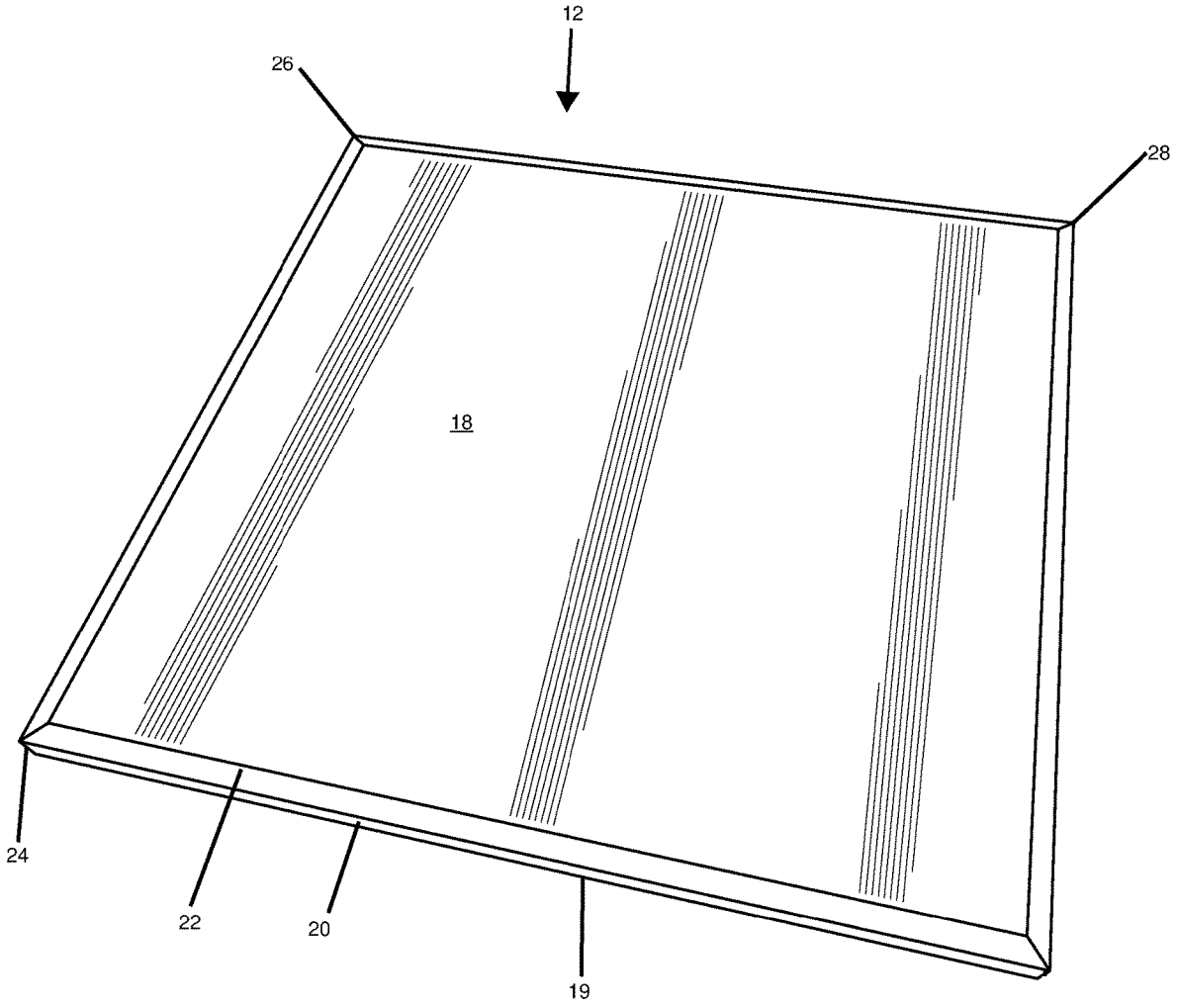
FIG. 3 shows a perspective view of the geometric body of the polygon tile according to one embodiment of the present disclosed technology.

Referring now to FIG. 3, in conjunction with FIG. 2, FIG. 3 shows a perspective view of the geometric body of the polygon tile according to one embodiment of the present disclosed technology. The geometric body 12 includes a flat upper surface 18, a lower surface 19 opposite the upper surface 18, a side perimeter wall 20 extending between the upper surface 18 and the lower surface 19, and a chamfered edge 22 extending from the upper surface 18 to the side perimeter wall 20. The side perimeter wall 20 defines at least a first corner 24, a second corner 26, and a third corner 28, in which the second corner 26 disposed between the first corner 24 and the third corner 28. The chamfered edge 22 extends around the entire perimeter of the upper surface 18 such that it circumscribes the upper surface 18. In embodiments, the first corner 24, the second corner 26, and the third corner 28 each form an angle within the range of 0° to 180°. The body 12 may comprises any regular or irregular geometric polygon shape such as a triangle, quadrilateral, pentagon, hexagon, octagon, and the like. The body 12 may comprise either wood, plastic, metal, glass, ceramic, or any combination of the same.

Figure 4:
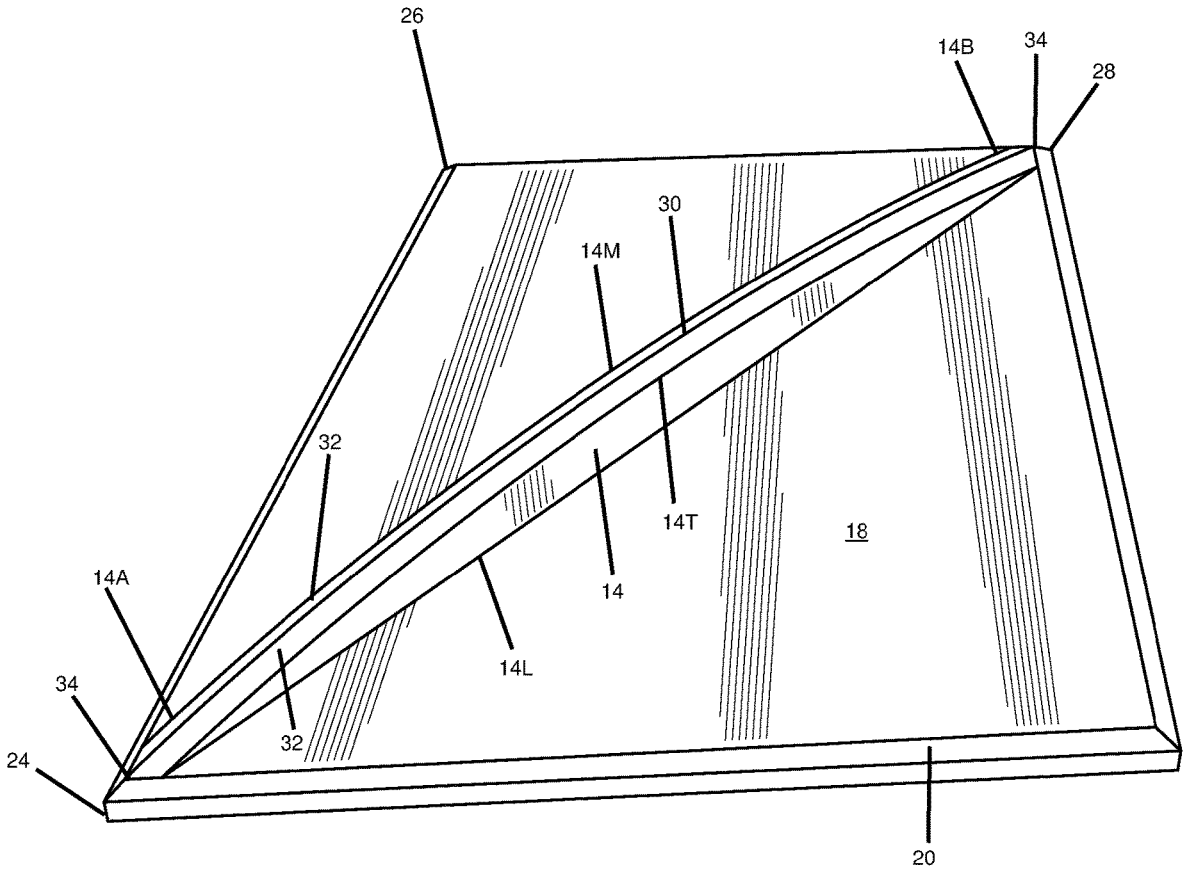
FIG. 4 shows a perspective view of the cross-member attached to the geometric body of the polygon tile according to one embodiment of the present disclosed technology.
Figure 5:
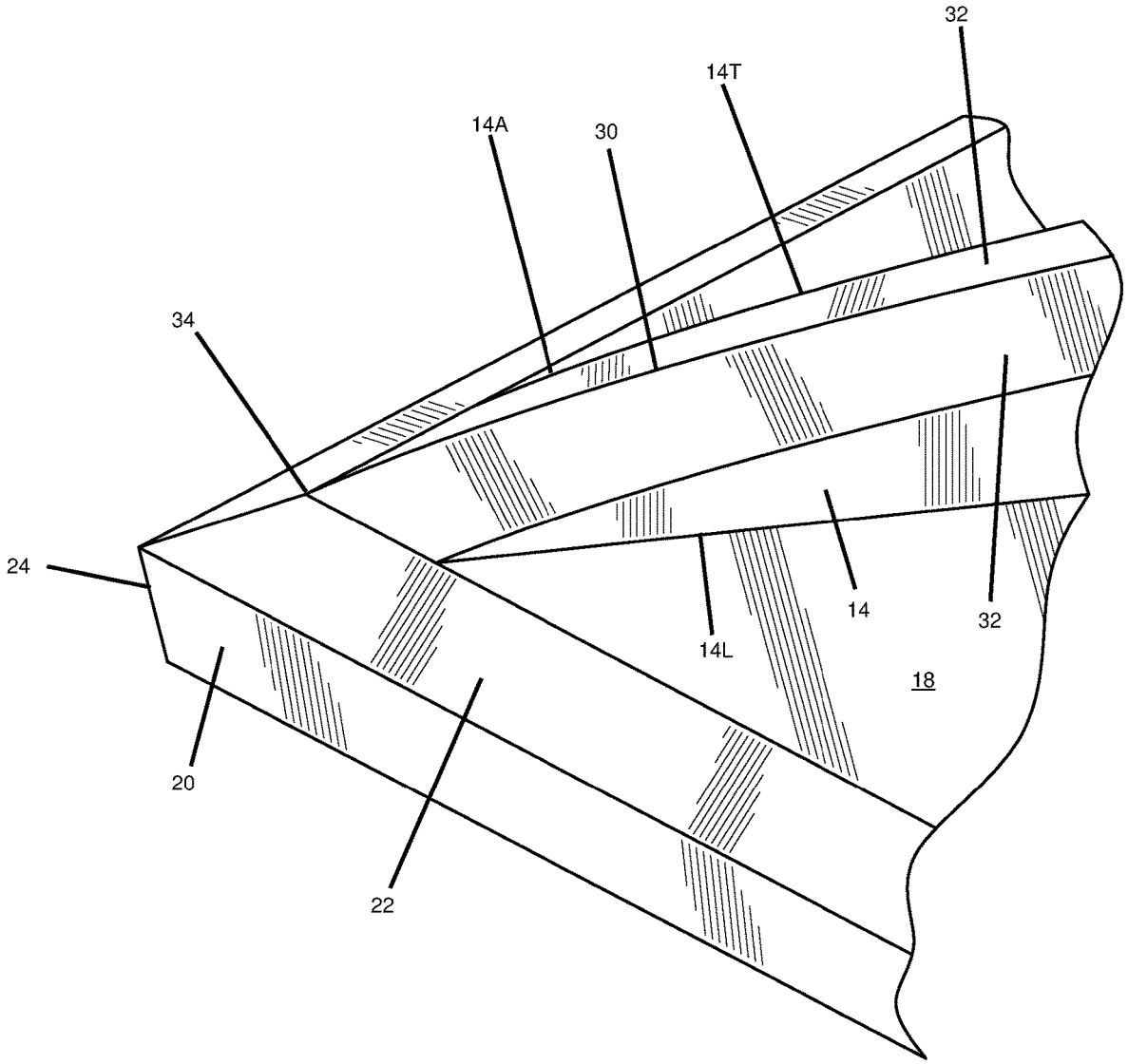
FIG. 5 shows a close-up view of a corner of the geometric body of the polygon tile with the cross-member attached thereto according to one embodiment of the present disclosed technology.

Referring now to FIG. 4 and FIG. 5, in conjunction with FIG. 2, FIG. 4 shows a perspective view of the cross-member attached to the geometric body of the polygon tile according to one embodiment of the present disclosed technology. FIG. 5 shows a close-up view of a corner of the geometric body of the polygon tile with the cross-member attached thereto according to one embodiment of the present disclosed technology. The elongated cross-member 14 extends from the first corner 24 to the third corner 28. Note, the elongated cross-member 14 extends to opposite corners of body 12. The cross-member 14 includes a first end 14A, a second end 14B opposite the first end 14A, a middle portion 14M extending between the first end 14A and the second end 14B, bottom end 14L including a flat surface attached to the upper surface 18 of the body 12, and a tapered top end 14T tapering in width to an apex 30. In embodiments, the tapered top end 14T includes a pair of tapered edges 32 that taper in parallel to the apex 30.

The first end 14A is disposed above the first corner 24 of the body 12. The second end 14B is disposed above the third corner 28. The elongated cross-member 14 tapers longitudinally in height from the middle portion 14M to the first end 14A and from the middle portion 14M to the second end 14B such that the height of the cross-member 14 at the middle portion 14M is larger than the height of the cross-member 14 at the first end 14A and the second end 14B. The elongated cross-member 14 includes a width smaller than a width of the body 12. Further, the elongated cross-member 14 tapers longitudinally in height from the middle portion 14M to the first end 14A and from the middle portion 14M to the second end 14B such that the first end 14A is substantially coextensive in height with the first corner 24 and the second end is substantially coextensive in height with third corner 28. The cross-member 14 also tapers longitudinally in height from the middle portion 14M to the first end 14A and the second end 14B such that the tapered top end 14T is substantially coextensive with the flat bottom end 14L at the first end 14A and at the second end 14B. In embodiments, the cross-member 14 further tapers longitudinally in height from the middle portion 14M to the first end 14A and to the second end 14B such that the tapered top end 14T is curvilinear forming a bowed shape or contour. The middle portion 14M defines the highest portion of the polygon tile 10. In some embodiments, the first end 14A and the second end 14B finish at peaks 34 that include substantially the same dimensions of the upper surface 18 of the body 12 at the first corner 24 and the third corner 28. Note, the peaks 34 are positioned inside the chamfered edge 22 such that they do not extend thereover. In embodiments, the apexes 30 of the tapered top end 14T align with the first and second corners 24, 28 at the first and second ends 14A, 14B. The cross-member 14 may comprise wood, plastic, metal, glass, ceramic, or any combination of the same.

The sheet 16 extends tautly over the cross-member 14, the flat upper surface 18 of the body 12, and the side perimeter wall 20 of the body 12 and includes a perimeter edge 36 that is attached in a flush-like manner to the lower surface 19 of the body 12. The sheet 16 contacts the apex 30 of the tapered top end 14T, the chamfered edge 22, and the side perimeter wall 20, such that the sheet 16 rests flat and/or flush with the chamfered edge 22 and the side perimeter wall 20. The sheet 16 slopes from the middle portion 14M of the cross-member 14 to the side perimeter wall 20 in every direction. The sheet 16 follows the contours and height of the cross-member 14. The sheet may comprise a fabric material, a laminate material, a plastic material, a paper material, or any combination of the same.

Figure 14:
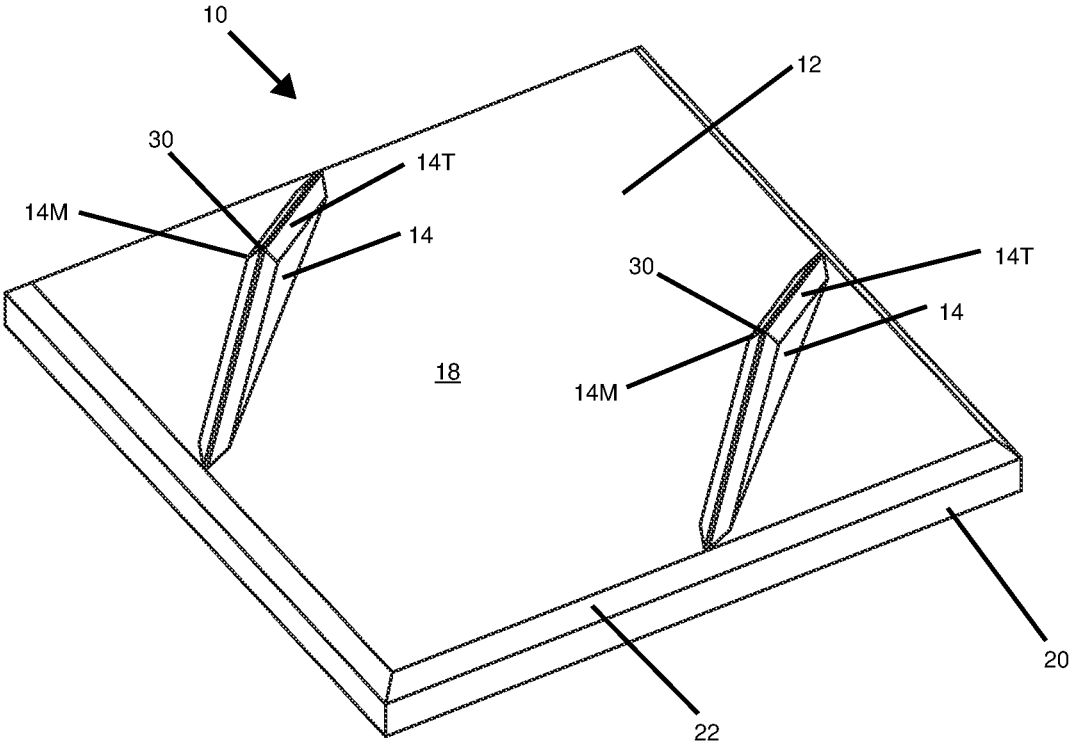
FIG. 14 shows a perspective view of a pair of cross-members attached to the polygon tile, illustrating another way the polygon tile may be formed according to another embodiment of the present disclosed technology.
Figure 15:
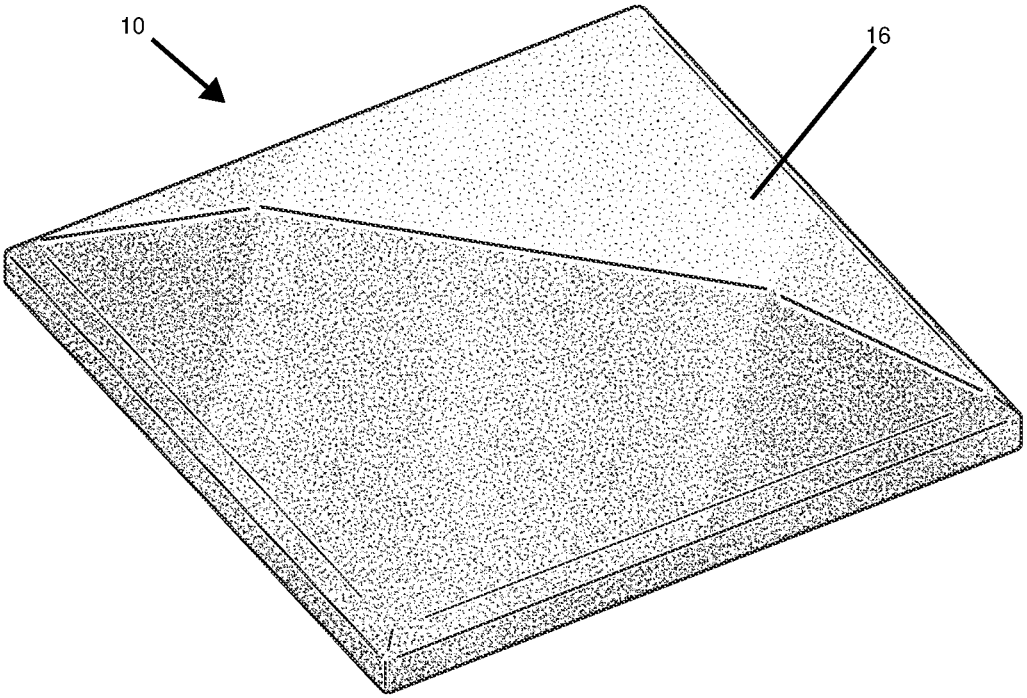
FIG. 15 shows a perspective view of the polygon tile of FIG. 14, illustrating the sheet mounted thereon according to one embodiment of the present disclosed technology.
Figure 16:
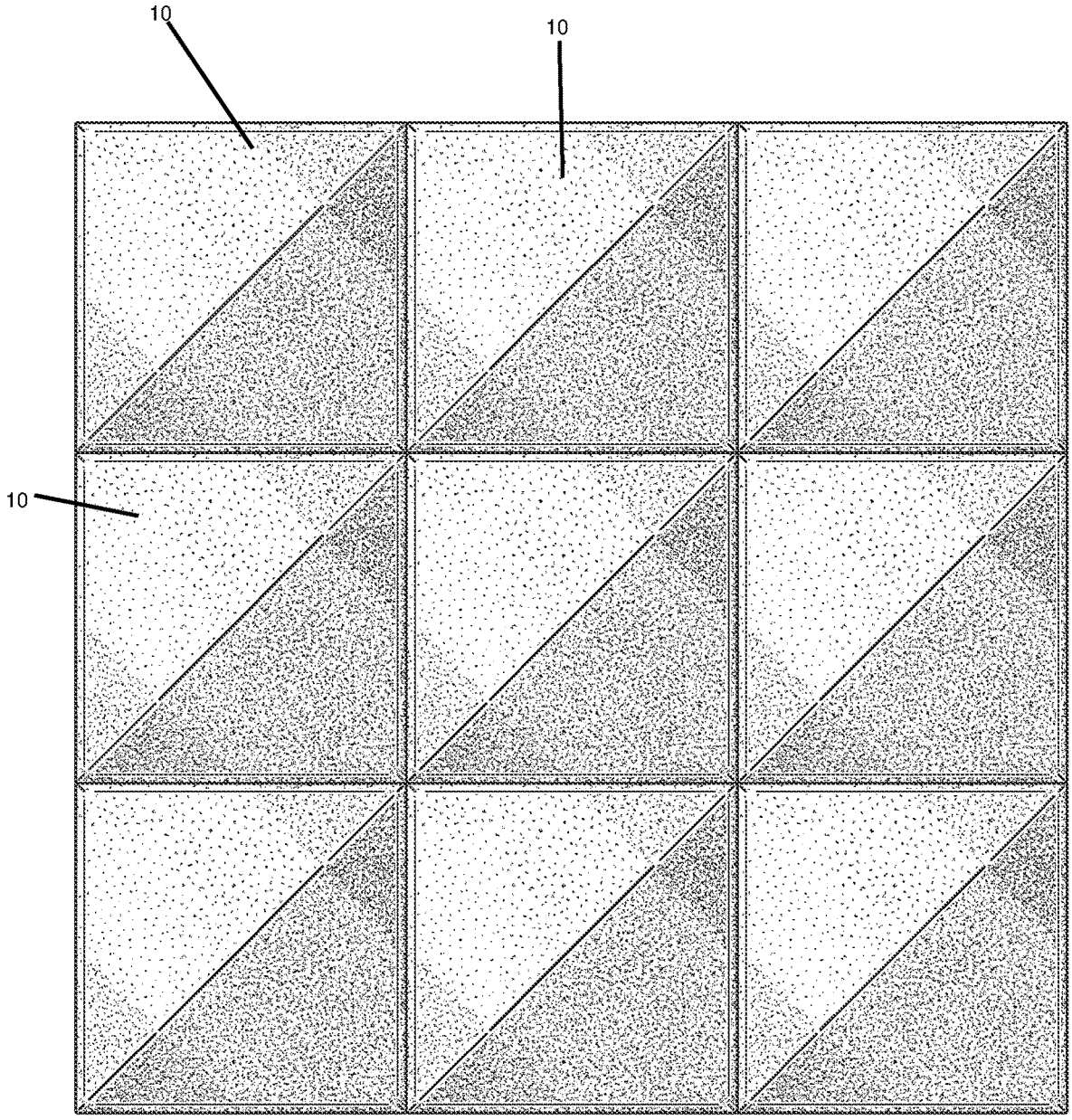
FIG. 16 shows still another three-dimensional tessellation formed using various polygon tiles of FIG. 15 according to one embodiment of the present disclosed technology.
Figure 17:
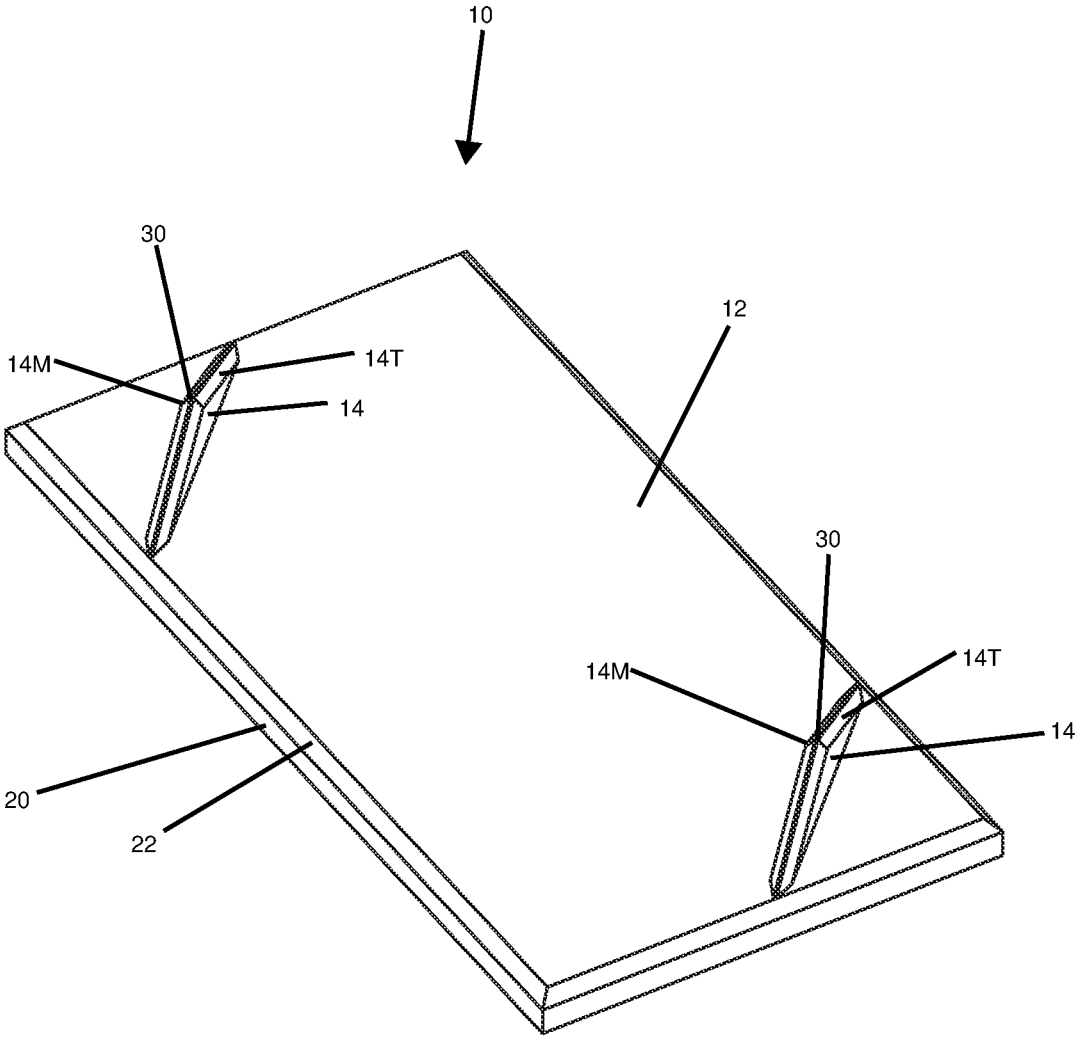
FIG. 17 shows a perspective view of a pair of cross-members attached to the polygon tile, illustrating still another shape the polygon tile may take according to another embodiment of the present disclosed technology.

Referring now to FIG. 14, FIG. 15, and FIG. 17, FIG. 14 shows a perspective view of a pair of cross-members attached to the polygon tile, illustrating another way the polygon tile may be formed according to another embodiment of the present disclosed technology. FIG. 15 shows a perspective view of the polygon tile of FIG. 14, illustrating the sheet mounted thereon according to one embodiment of the present disclosed technology. FIG. 17 shows a perspective view of a pair of cross-members attached to the polygon tile, illustrating still another shape the polygon tile may take according to another embodiment of the present disclosed technology. In embodiments, the polygon tile 10 includes a pair of cross-members 14 extending across the body 12 in parallel from a first side of the side perimeter wall 20 to a second side of the side perimeter wall 20. The sheet 16 extends tautly over the pair of cross-members 14, the flat upper surface 18 of the body 12, and the side perimeter wall 20 of the body 12. The sheet 16 contacts the apex 30 of the tapered top end 14T, the chamfered edge 22, and the side perimeter wall 20, such that the sheet 16 rests flat and/or flush with the chamfered edge 22 and the side perimeter wall 20. The sheet 16 slopes from the middle portion 14M of the each of the cross-members 14 to the side perimeter wall 20 in every direction. The sheet 16 follows the contours and height of the cross-member 14.

Figure 8:
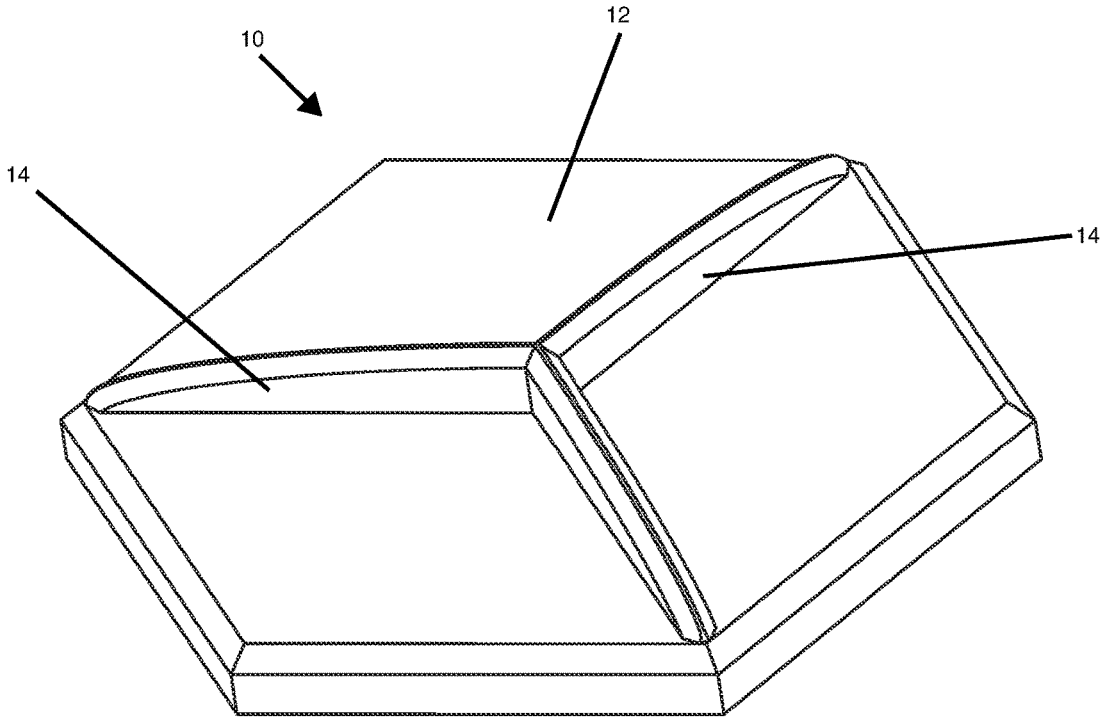
FIG. 8 shows a perspective view of the cross-member attached to the polygon tile, illustrating another shape the polygon tile may take according to another embodiment of the present disclosed technology.
Figure 9:
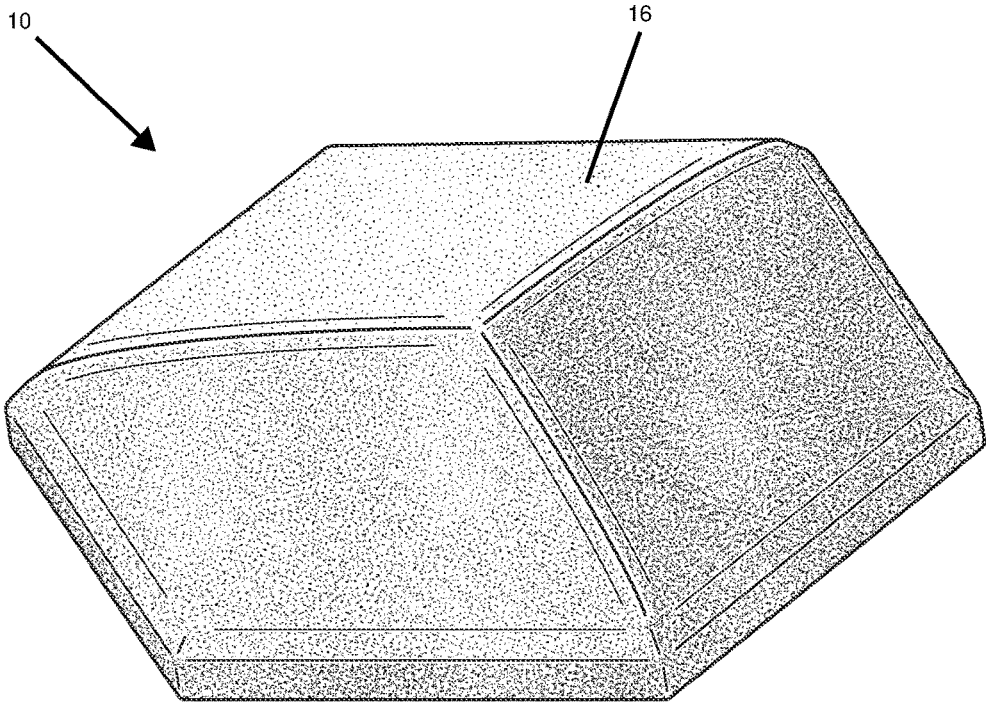
FIG. 9 shows a perspective view of the polygon tile of FIG. 8, illustrating the sheet mounted thereon according to one embodiment of the present disclosed technology.
Figure 11:
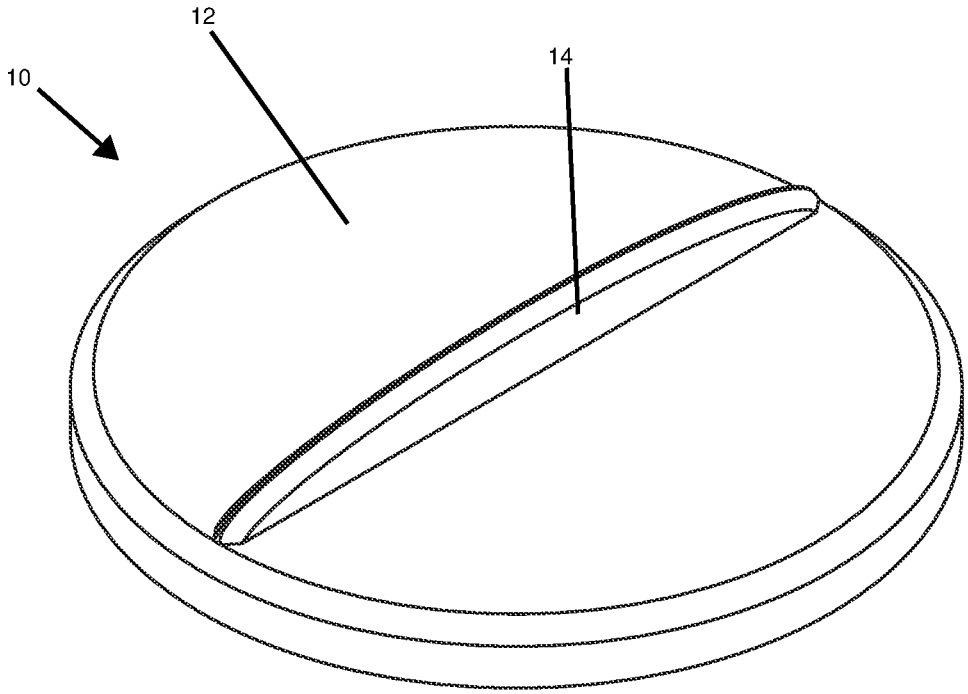
FIG. 11 shows a perspective view of the cross-member attached to the polygon tile, illustrating yet another shape the polygon tile may take according to another embodiment of the present disclosed technology.
Figure 12:
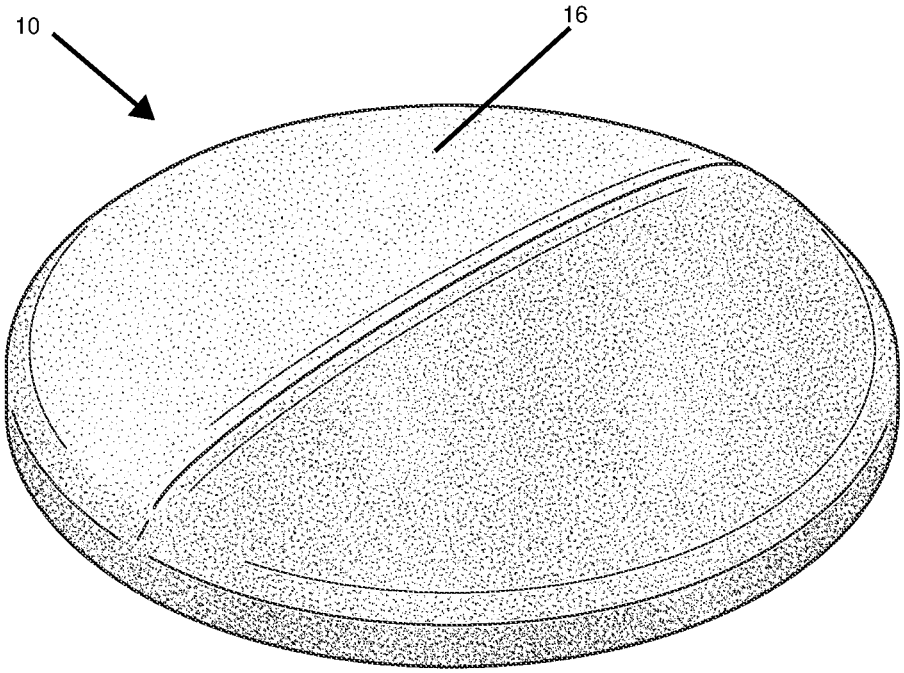
FIG. 12 shows a perspective view of the polygon tile of FIG. 11, illustrating the sheet mounted thereon according to one embodiment of the present disclosed technology.

Referring now to FIG. 8, FIG. 9, FIG. 11, and FIG. 12, FIG. 8 shows a perspective view of the cross-member attached to the polygon tile, illustrating another shape the polygon tile may take according to another embodiment of the present disclosed technology. FIG. 9 shows a perspective view of the polygon tile of FIG. 8, illustrating the sheet mounted thereon according to one embodiment of the present disclosed technology. FIG. 11 shows a perspective view of the cross-member attached to the polygon tile, illustrating yet another shape the polygon tile may take according to another embodiment of the present disclosed technology. FIG. 12 shows a perspective view of the polygon tile of FIG. 11, illustrating the sheet mounted thereon according to one embodiment of the present disclosed technology. In embodiments, the body 12 may comprise any shape, such as a cube and a circle, and include any number of cross-members 14 covered by the sheet 16 to form different geometric polygon tiles capable of tessellation.

Figure 6:
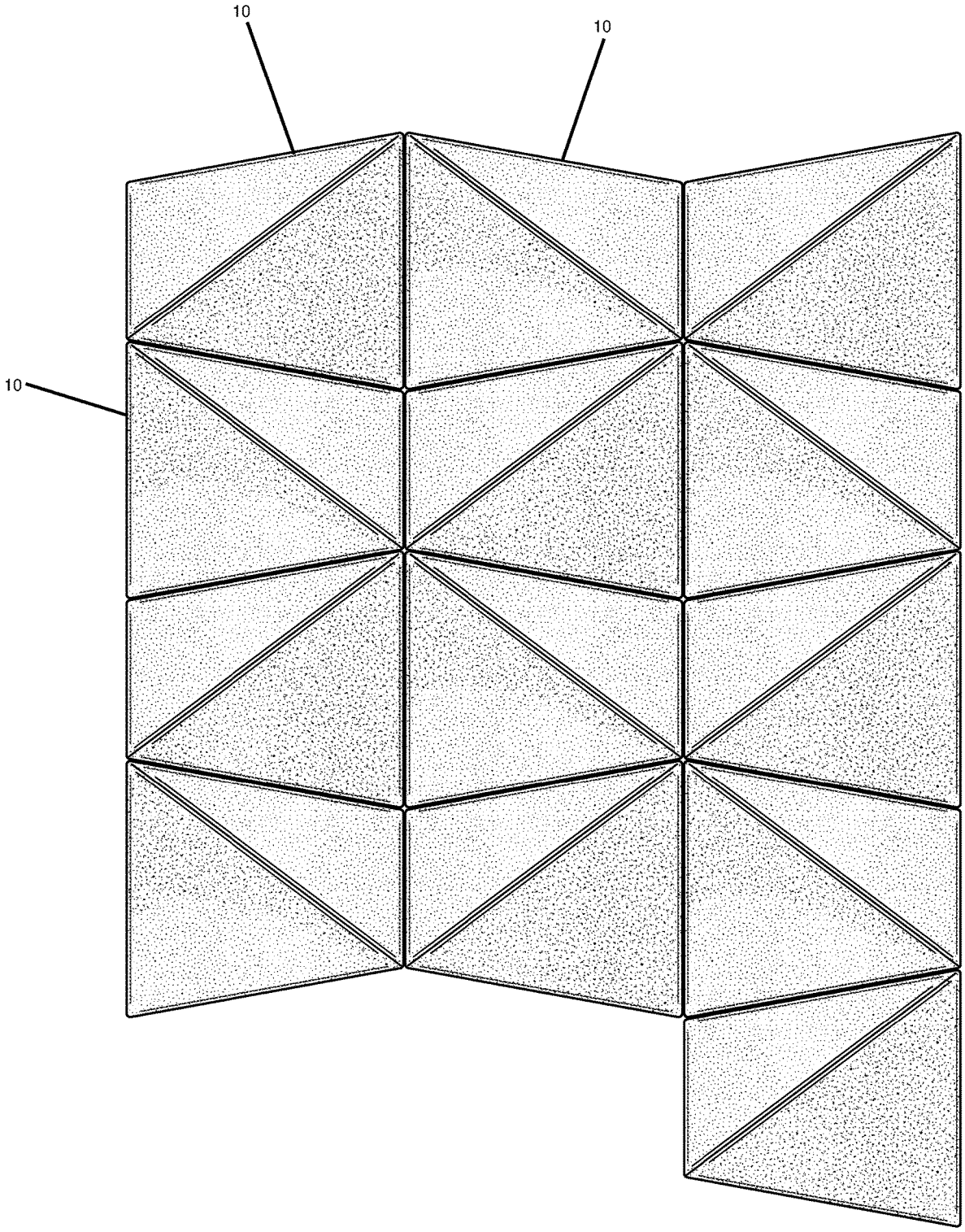
FIG. 6 shows a three-dimensional tessellation formed using various polygon tiles according to one embodiment of the present disclosed technology.
Figure 7:
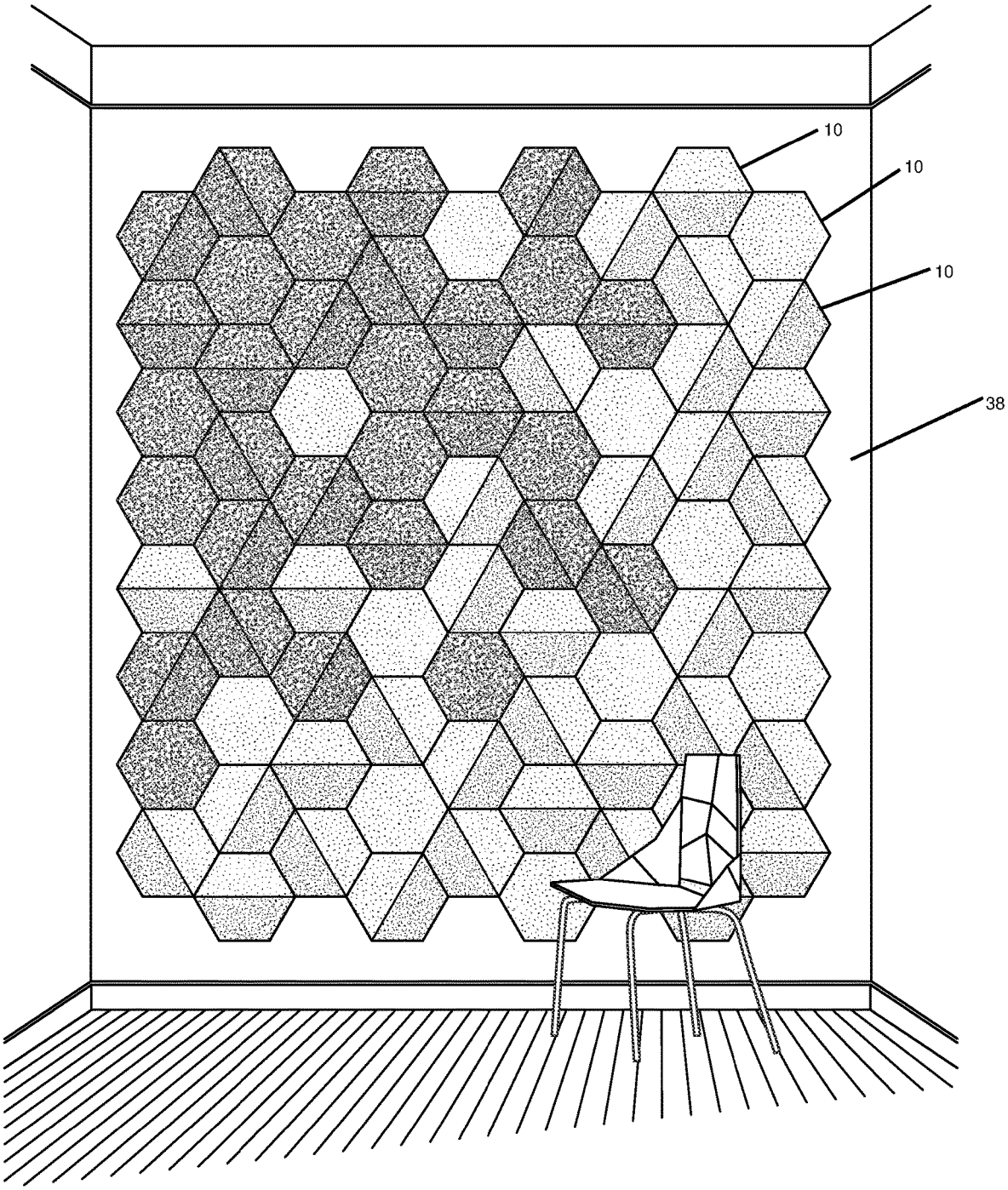
FIG. 7 shows another three-dimensional tessellation formed using various polygon tiles according to one embodiment of the present disclosed technology.
Figure 10:
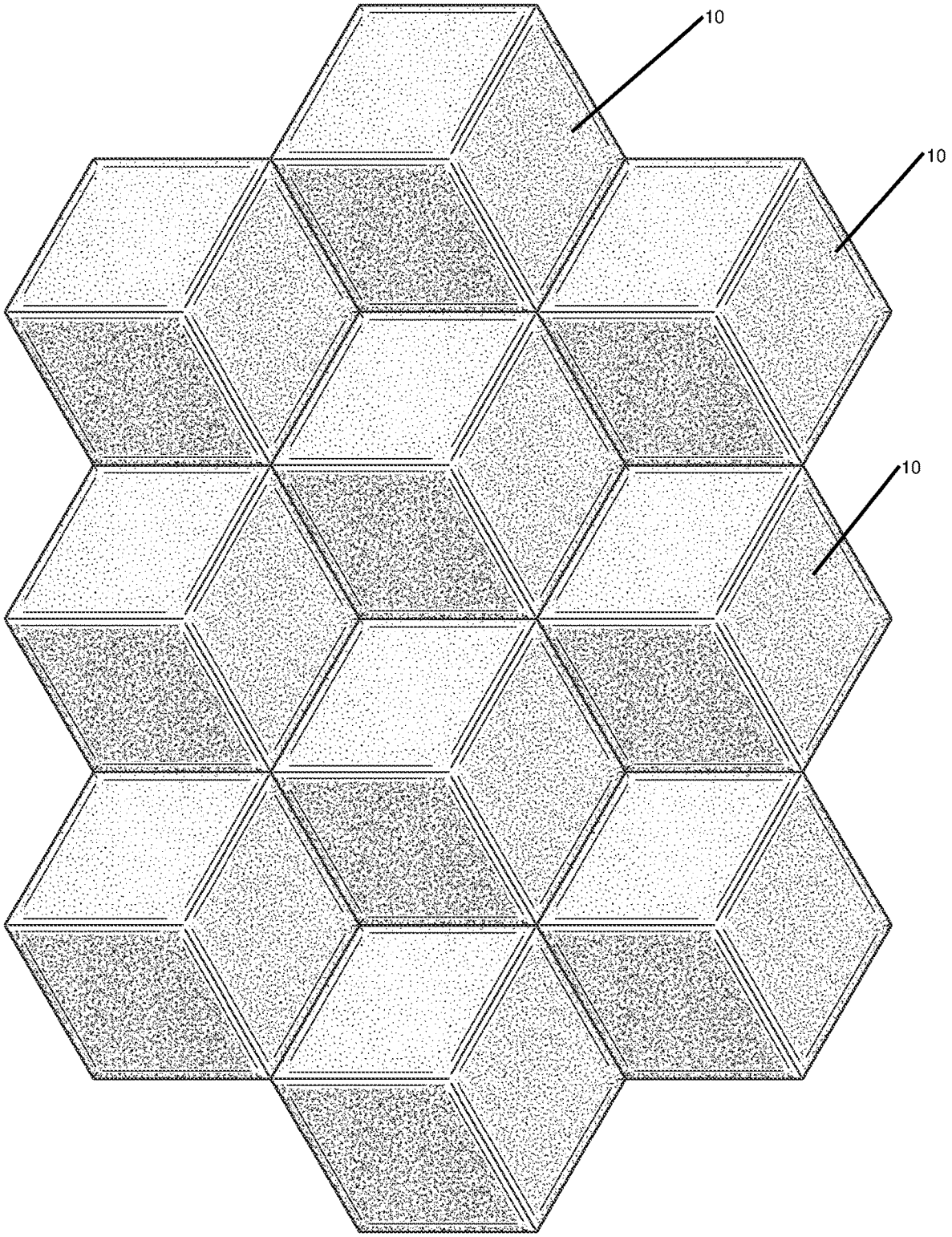
FIG. 10 shows yet another three-dimensional tessellation formed using various polygon tiles of FIG. 9 according to one embodiment of the present disclosed technology.
Figure 13:
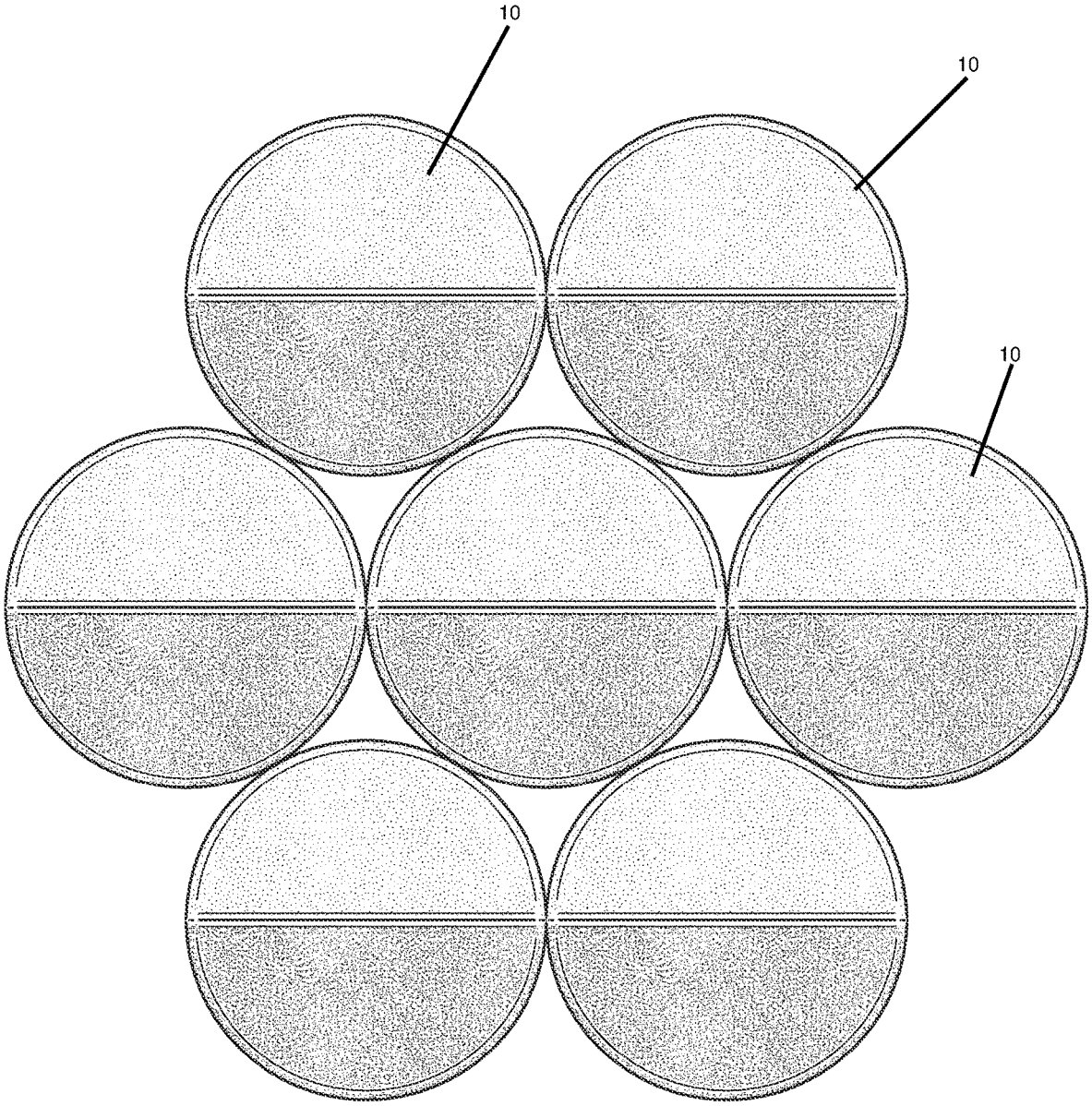
FIG. 13 shows still another three-dimensional tessellation formed using various polygon tiles of FIG. 12 according to one embodiment of the present disclosed technology.

Referring now to FIG. 6, FIG. 7, FIG. 10, and FIG. 13, in conjunction with FIG. 2, FIG. 6 shows a three-dimensional tessellation formed using various polygon tiles according to one embodiment of the present disclosed technology. FIG. 7 shows another three-dimensional tessellation formed using various polygon tiles according to one embodiment of the present disclosed technology. FIG. 10 shows yet another three-dimensional tessellation formed using various polygon tiles of FIG. 9 according to one embodiment of the present disclosed technology. FIG. 13 shows still another three-dimensional tessellation formed using various polygon tiles of FIG. 12 according to one embodiment of the present disclosed technology. In embodiments of the present disclosed technology, the polygon tile 10 is made by attaching, via an adhesive or fastener, the flat bottom surface 14L of the elongated cross-member 14 to the flat upper surface 18 of the body 12 such that cross-member 14 is positioned on the flat upper surface of the body 12 between the first corner 24 and the third corner 28, extending therebetween. Next, the sheet 16 is extended tautly over the elongated cross-member 14 and pulled over the side perimeter wall 20 to the lower surface 19 of the body 12 such that the sheet 16 rests flat on the chamfered edge 22 and the side perimeter wall 20, and the sheet 16 slopes from the middle portion 14M of the cross-member to the side perimeter wall 20. Lastly, the perimeter edge of the sheet 16 is attached to the lower surface 19 of the body 12, via an adhesive or fastener. In operation, various polygon tiles 10 including the same or different geometric shape may be arranged on a surface 38 to form a tessellation.

Any device or step to a method described in this disclosure can comprise or consist of that which it is a part of, or the parts which make up the device or step. The term "and/or" is inclusive of the items which it joins linguistically and each item by itself.

For purposes of this disclosure, the term "substantially" is defined as "at least 95% of" the term which it modifies.

Any device or aspect of the technology can "comprise" or "consist of" the item it modifies, whether explicitly written as such or otherwise.

When the term "or" is used, it creates a group which has within either term being connected by the conjunction as well as both terms being connected by the conjunction.

While the disclosed technology has been disclosed with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

What is claimed is:

1. A polygon tile for tessellating, comprising:

a planar geometric body including a flat upper surface, a lower surface, the flat upper surface opposite the lower surface, and a side perimeter wall extending between the flat upper surface and the lower surface, the side perimeter wall defining at least a first corner, a second corner, and a third corner, the second corner disposed between the first corner and the third corner;

an elongated cross-member extending from the first corner to the third corner, the cross-member including a first end and a second end, the first end opposite the second end, a middle portion disposed between the first end and the second end, a bottom end including a flat surface attached to the flat upper surface of the body, and a tapered top end tapering in width to an apex, the elongated cross-member tapering in height from the middle portion to the first end and from the middle portion to the second end such that the height of the cross-member at the middle portion is larger than the height of the cross-member at the first end and the second end, the elongated cross-member having a width smaller than a width of the body; and a sheet extending tautly over the cross-member, the flat upper surface, and the side perimeter wall of the body, the sheet sloping from the middle portion of the cross-member to the side perimeter wall.

2. The polygon tile of claim 1, wherein:

the first end of the cross-member is disposed above the first corner;

the second end of the cross-member is disposed above the third corner; and the elongated cross-member tapers in height from the middle portion to the first end and from the middle portion to the second end such that the first end is substantially coextensive in height with the first corner and the second end is substantially coextensive in height with the third corner.

3. The polygon tile of claim 1, wherein the cross-member tapers in height from the middle portion to the first end and the second end such that the tapered top end is substantially coextensive with the flat bottom end at the first end and at the second end.

4. The polygon tile of claim 1, wherein the cross-member tapers in height from the middle portion to the first end and the second end such that the tapered top end is curvilinear forming a bowed shape.

5. The polygon tile of claim 1, wherein the body further comprises an upper chamfered edge extending from the flat upper surface to the side perimeter wall.

6. The polygon tile of claim 5, wherein the sheet rests flat on the chamfered edge of the body.

7. The polygon tile of claim 1, wherein the sheet comprises a perimeter edge attached to the lower surface of the body.

8. The polygon tile of claim 1, wherein the first corner, the second corner, and the third corner each form an angle within the range of 0° to 180°.

9. The polygon tile of claim 1, wherein the body comprises either wood, plastic, metal, glass, ceramic, or any combination of the same.

10. The polygon tile of claim 1, wherein the cross-member comprises either wood, plastic, metal, glass, ceramic, or any combination of the same.

11. The polygon tile of claim 1, wherein the sheet comprises either fabric material, a laminate material, a plastic material, a paper material, or any combination of the same.

12. A method of making a polygon tile for tessellating, comprising:

attaching an elongated cross-member including a first end, a second end, a middle portion disposed between the first end and the second end, a flat bottom end including a flat surface, and a tapered top end tapering in width to an apex to a geometric polygon shaped planar body including a flat upper surface, a lower surface, a first corner, a second corner, and a third corner, the second corner disposed between the first corner and the third corner;

extending a sheet of material tautly over the elongated cross-member and the body; and attaching the sheet of material to the body such that the sheet remains tautly extended over the cross-member and the body, and the sheet slopes from the middle portion of the cross-member to the side perimeter wall;

wherein the elongated cross-member tapers in height from the middle portion to the first end and to the second end such that the height of the cross-member at the middle portion is larger than the height of the cross-member at the first end and the second end.

13. The method of claim 12, wherein the cross-member is attached to the body by:

positioning the cross-member on the flat upper surface of the body between the first corner and the third corner of the body, such that the cross-member extends from the first corner the third corner; and adhering the flat surface of the bottom end of the cross-member to the flat upper surface of the body.

14. The method of claim 13, wherein the first end of the cross-member is substantially coextensive in height with the first corner and the second end of the cross-member is substantially coextensive in height with the second corner.

15. The method of claim 14, wherein the cross-member tapers in height from the middle portion to the first end and the second end such that:

the tapered top end is coextensive with the flat bottom end at the first end and the second end; and that the tapered top end is curvilinear forming a bowed shape.

16. The method of claim 15, wherein:

the body further comprises an upper chamfered edge extending from the flat upper surface to the side perimeter wall; and the sheet comprises a perimeter edge.

17. The method of claim 16, wherein the sheet of material is attached to the body by:

extending the sheet of material over the body and the cross-member such that the sheet of material rests flat on the chamfered edge of the body and the sheet of material is pulled over the side perimeter wall to the lower surface of the body; and adhering the perimeter edge of the sheet of material to the lower surface of the body.

* * * * *